US006302012B1

(12) United States Patent
Dantlgraber et al.

(10) Patent No.: US 6,302,012 B1
(45) Date of Patent: Oct. 16, 2001

(54) ARRANGEMENT FOR THE SUPPLY OF PRESSURE MEDIUM TO A HYDRAULIC OR PNEUMATIC CYLINDER

(75) Inventors: Jörg Dantlgraber; Udo Fröhlich, both of Lohr/Main (DE)

(73) Assignee: Mannesmann Rexroth AG, Lohr/Main (DE)

( * ) Notice: Subject to any disclaimer, the term of this patent is extended or adjusted under 35 U.S.C. 154(b) by 0 days.

(21) Appl. No.: 09/439,237

(22) Filed: Nov. 12, 1999

(30) Foreign Application Priority Data

Nov. 16, 1998 (DE) ..... 198 52 510
Oct. 8, 1999 (DE) ..... 199 48 531

(51) Int. Cl.[7] ..... F15B 15/20
(52) U.S. Cl. ..... 92/163
(58) Field of Search ..... 92/163, 164

(56) References Cited

U.S. PATENT DOCUMENTS 2,953,118 * 9/1960 Flick et al. ..... 92/164 X
2,978,283 * 4/1961 Rosen ..... 92/164
4,860,638 * 8/1989 Hosono et al. ..... 92/163 X
4,878,419 11/1989 Vick ..... 92/163
5,094,143 * 3/1992 Andersen, Jr. ..... 92/164 X

FOREIGN PATENT DOCUMENTS

399046 * 7/1924 (DE) ..... 92/163
2939422 4/1981 (DE) .

OTHER PUBLICATIONS

RD/E/F 17 032/08.98 Hydrozylinder/Hydraulic Cylinder/Vérin Hydraulique TYP CDT 3/CGT, from Mannesmann Rexroth AG, pp. 1/42, 40/42 and 41/42.

* cited by examiner

*Primary Examiner*—John E. Ryznic
(74) *Attorney, Agent, or Firm*—Martin A. Farber

(57) ABSTRACT

The supply of pressure medium to hydraulic or pneumatic cylinders is usually carried out by means of pressure medium lines which are connected to the heads of the cylinders by means of standardized connection threads. This method of supplying pressure medium requires a minimum wall thickness of the casing of the cylinder in the connection region. In order to permit secure attachment of the pressure medium lines even when the minimum thickness which is necessary for the use of the standardized connection thread is not present, the outside of the casing of the cylinder is flattened in the vicinity of the exit point of a duct provided for the supply of pressure medium. A connection plate which is provided with ducts for the pressure medium is secured to the flattened part of the casing, and the connection plate is provided with a port for a pressure medium line. This arrangement for the supply of pressure medium is suitable in particular for cylinders of small size whose casings have only a small wall thickness or in which the pressure medium lines are to be conducted near to the casing of the cylinder.

13 Claims, 4 Drawing Sheets

ARRANGEMENT FOR THE SUPPLY OF PRESSURE MEDIUM TO A HYDRAULIC OR PNEUMATIC CYLINDER

FIELD AND BACKGROUND OF THE INVENTION

The invention relates to an arrangement for the supply of pressure medium to a hydraulic or pneumatic cylinder. In hydraulic and pneumatic cylinders, the supply of pressure medium is usually carried out by means of pressure medium lines which are connected to the heads of the cylinders. In the vicinity of the heads of the cylinder, there is usually a sufficient wall thickness for receiving standardized connection threads for pressure medium lines. Such a cylinder for hydraulic pressure medium is represented, for example, in the company document RD/E/F 17 032/08.98 "Hydrozylinder/Hydraulic Cylinder/Vérin Hydraulique—Type CDT3/CGT3" from Mannesmann Rexroth AG, in particular on pages 1/42, 40/42 and 41/42. The axes of the connection threads are perpendicular to the longitudinal direction of the cylinder. If the pressure medium lines are to be arranged parallel to the longitudinal direction of the cylinder, angular elements are necessary for the reversal of direction. Because of the minimum radii which have to be complied with here, it is difficult, if not even impossible, to conduct the pressure medium lines along right next to the casing of the cylinder. There is a further problem in hydraulic and pneumatic cylinders of small size. In them, the wall thickness of the casing is so small that it is no longer sufficient for standardized connection threads. Secure attachment of the pressure medium lines is not necessary in these cases.

SUMMARY OF THE INVENTION

The invention is based on the object of providing an arrangement for a reliable supply of pressure medium even in cylinders of a small size in which the wall thickness of the casing is not sufficient for standardized connection threads for the attachment of the pressure medium lines.

The arrangement according to the invention makes it possible to conduct the pressure medium lines right next to the casing of the cylinder. The flattening of the casing of the cylinder which is provided for the bearing of the connection plate can be manufactured easily.

The detachable connection between the casing of the cylinder and the connection plate makes it possible firstly to attach the pressure medium line to the connection plate and only afterward to screw the connection plate (with the pressure medium line attached to it) to the casing of the cylinder. Given a rectangular base surface of the bearing region it is possible to arrange the connection plate in two positions which are turned through 180°. Given a square base surface of the bearing region of the connection plate in conjunction with the four screws which are arranged in the corners of the square base surface it is possible to arrange the connection plate rotated in each case through 90° where necessary. The direction of flow of the pressure medium is already deflected in the connection plate by means of ducts which are arranged perpendicularly to one another. Thus, external angular elements between the cylinder and the pressure medium lines are dispensed with. Two pressure medium lines can be conducted one next to the other if the connection plate projects beyond a rectangular base surface on one side, and the connection for the pressure medium line is arranged on that part of the connection plate which projects beyond the rectangular base surface, in such a way that the port for the pressure medium line is arranged perpendicularly with respect to the longitudinal direction of the connection plate. By virtue of this measure, the port for the pressure medium line is arranged parallel to the longitudinal direction of the cylinder. If the port for the pressure medium line is embodied as a connection nipple, the pressure medium line can be attached to the connection nipple by means of a press-fit connection. Such a connection requires little space. There is sufficient space available for the tool required for the press-fit connection if the pressure medium line is already attached before the screwing of the connection plate to the casing of the cylinder. In order to simplify the fabrication of the connection plates provided with the connection nipple in comparison with a one-piece embodiment, the connection plate and the connection nipple are fabricated separately and both parts are held together by a screwed connection. In order to increase the mechanical strength of the screwed connection—in particular in the case of small wall thickness'—part of the connection nipple is embodied as a cylindrical bolt, guided through a bolt in the connection plate and secured by means of a screwed connection which is supported on two side faces, one opposite the other, of the connection plate. This embodiment makes it possible to mount the connection nipple on both sides of the connection plate as desired. A chamfer in the connection plate in the vicinity of the outlet opening of the hole serves as an abutment and antitwist protection for the connection nipple.

BRIEF DESCRIPTION OF THE DRAWINGS

The figures of the invention is explained in more detail below with its further details by means of an exemplary embodiment illustrated in the drawings, in which.

DETAILED DESCRIPTION OF THE PREFERRED EMBODIMENT

Identical components are provided with identical reference symbols.

Figure 2:
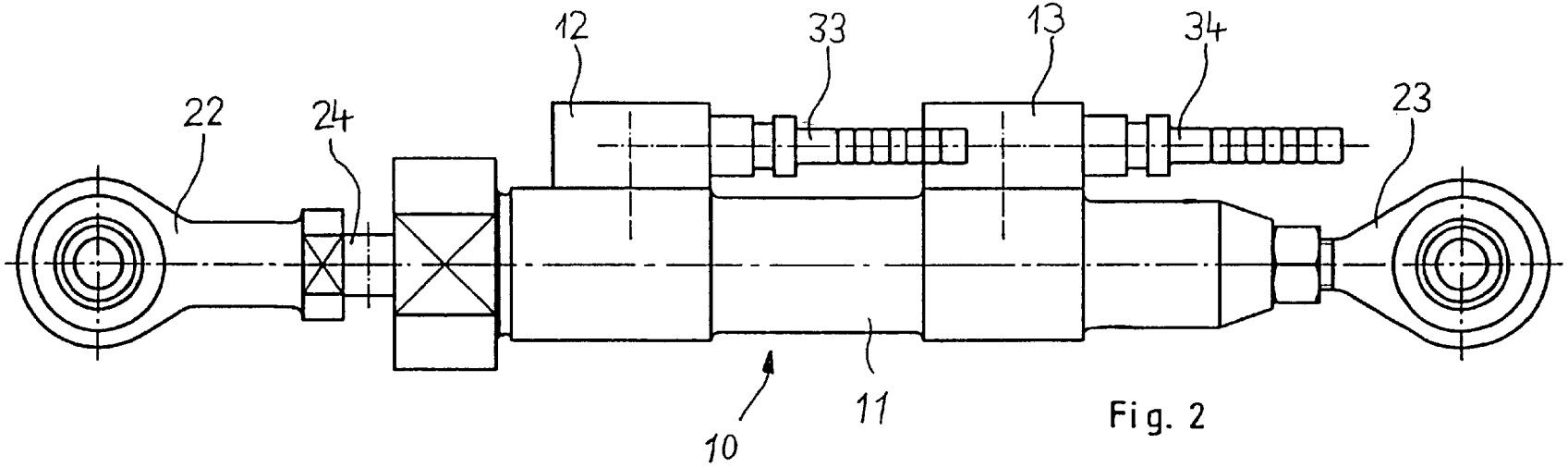
FIG. 2 shows the front view of the hydraulic cylinder which is illustrated in FIG. 1.
Figure 1:
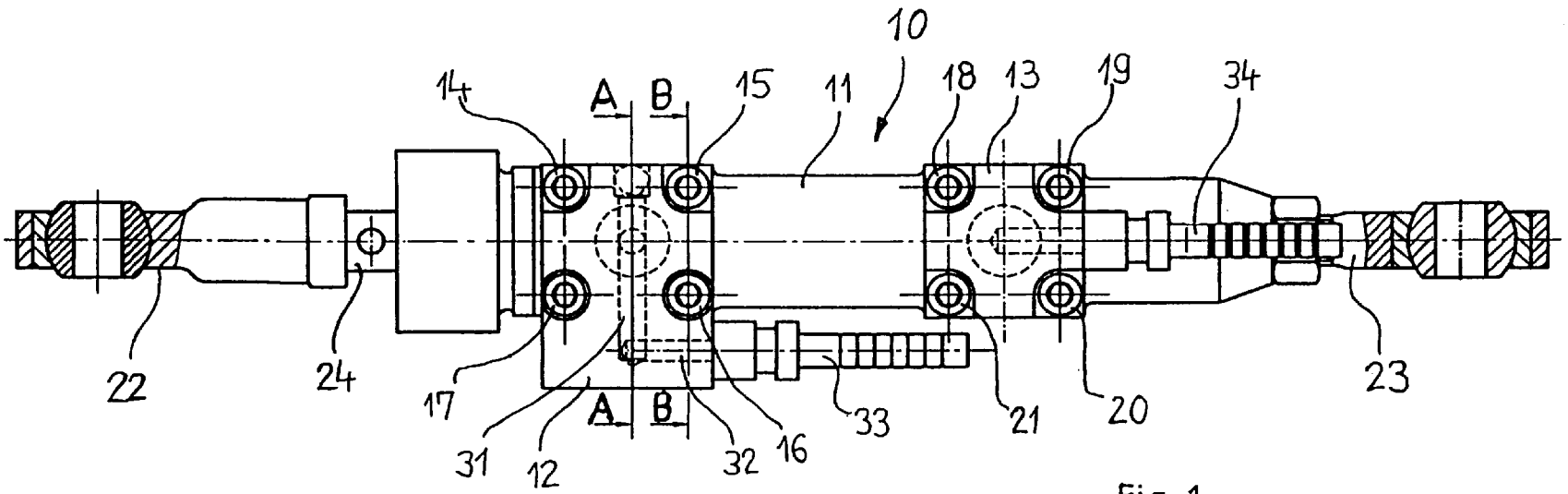
FIG. 1 shows the plan view of a hydraulic cylinder with two different arrangements for the supply of pressure medium.

FIGS. 1 and 2 show two different views of a hydraulic cylinder 10. FIG. 1 shows the plan view, FIG. 2 shows the front view. The casing of the hydraulic cylinder 10 is provided with the reference symbol 11. The supply of pressure medium to the hydraulic cylinder 10 is carried out via a first connection plate 12 into a first chamber of the hydraulic cylinder 10 and via a second connection plate 13 into a second chamber of the hydraulic cylinder 10. The connection plates 12 and 13 are secured to the casing 11 of the hydraulic cylinder 10 with, in each case, four screws 14 to 17 and 18 to 21. 22 and 23 designate two eyelets, the eyelet 22 of which is connected to the piston rod 24, and the eyelet 23 is connected to the casing 11 of the hydraulic cylinder 10.

Figure 3:
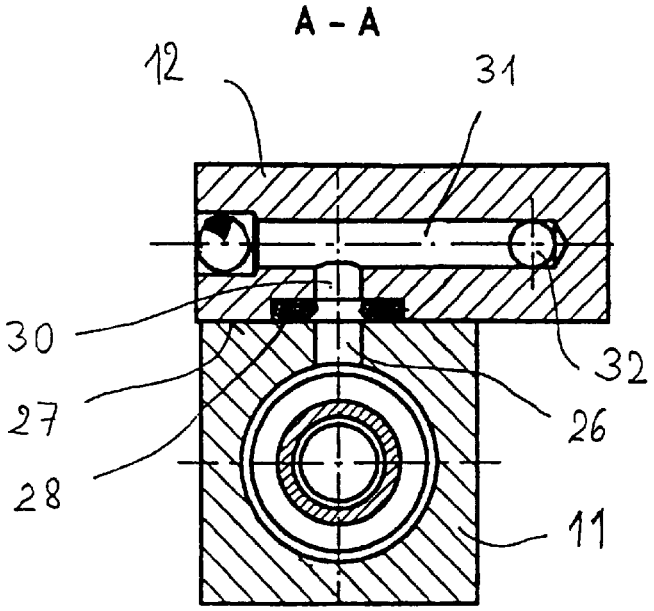
FIG. 3 shows a section along the line A—A in FIG. 1.

In the vicinities in which a duct for the supply of pressure medium to a chamber of the hydraulic cylinder 10 emerges from the casing 11, the casing 11 is flattened. In FIG. 3, which shows a section along the line A—A (cf. FIG. 1), the duct which is provided for the supply of pressure medium is provided with the reference symbol 26. The associated flattened portion of the casing 11 is provided with the reference symbol 27. The flattened portion has a square base surface. The connection plate 12 rests on the flattened portion 27. A sealing ring 28 is arranged between the casing 11 and the connection plate 12. The connection plate 12 is provided with ducts 30, 31 and 32. They connect the duct 26 to a connection nipple 33 which is arranged as an extension of the duct 32. The connection plate 12 projects beyond the square base surface on the one side. The duct 32 is located in the part of the connection plate 12 which projects beyond the square base surface of the flattened portion. It is arranged perpendicularly with respect to the duct 31 running in the longitudinal direction of the connection plate 12, and runs parallel to the longitudinal axis of the hydraulic cylinder 10. The connection nipple 33 is integrated into the connection plate 12. It serves as a port for a flexible hydraulic line (not illustrated in the figures). As FIGS. 1 and 2 show, the connection nipple 33 is arranged as closely as possible to the casing 11 of the hydraulic cylinder 10. So that sufficient space is nevertheless available for the tool which is necessary for pressing the hydraulic line with the connection nipple 33, the connection plate 12 is separated from the casing 11 of the hydraulic cylinder 10 by releasing the screws 14 to 17 for the attachment of the hydraulic line to the connection nipple 33.

Figure 4:
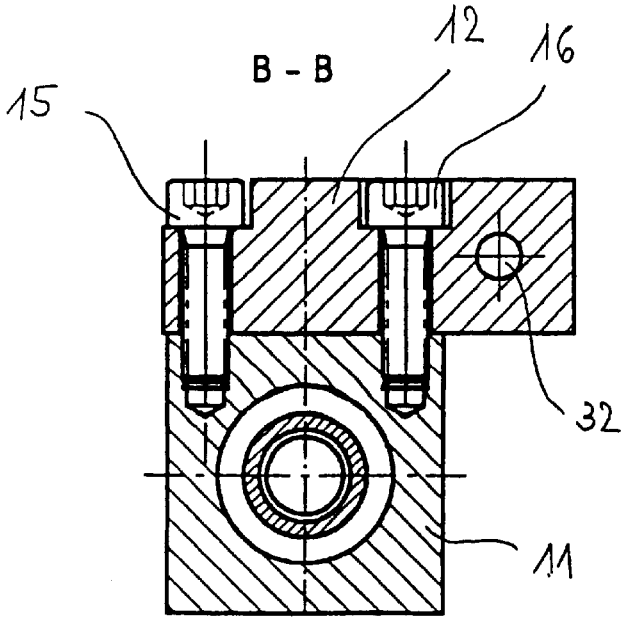
FIG. 4 shows a section along the line B—B in FIG. 1.

FIG. 4 shows, in a section along the line B—B (cf. FIG. 1), the attachment of the connection plate 12 to the casing 11. The screws 15 and 16 which are visible in the section are secured in a region of the casing 11 in which the thickness of the material of the casing 11 is greater than in the vicinity of the duct 26. In addition, the force with which the connection plate 12 is secured to the casing 11 is distributed between four screws.

The connection plate 13 is basically of the same design as the connection plate 12. However, the connection plate 13 does not project beyond the square base surface of the bearing region. A connection nipple 34 is integrated into the connection plate 13. It is arranged between the screws 19 and 20. By virtue of the lateral offset of the connection nipples 33 and 34, the hydraulic lines which are secured to them can be laid directly one next to the other. This is desired in particular if the hydraulic lines are to be conducted near to the casing 11 of the hydraulic cylinder 10 when the spatial conditions are restricted.

The square base surface of the bearing region of the connection plates 12 and 13, in connection with the arrangement of the screws 14 to 17 and 18 to 21 in the corners of the square base surface, makes it possible to mount the connection plates 12 and 13 rotated in increments of 90°, and also to exchange the connection plates 12 and 13 with one another where necessary.

When the hydraulic cylinder 10 is replaced, only the screws 14 to 21 need to be released. The connection plates 12 and 13 which are connected to the hydraulic lines can then be removed from the casing 11, and the connection plates 12 and 13 can be connected to the new hydraulic cylinder.

Figure 5:
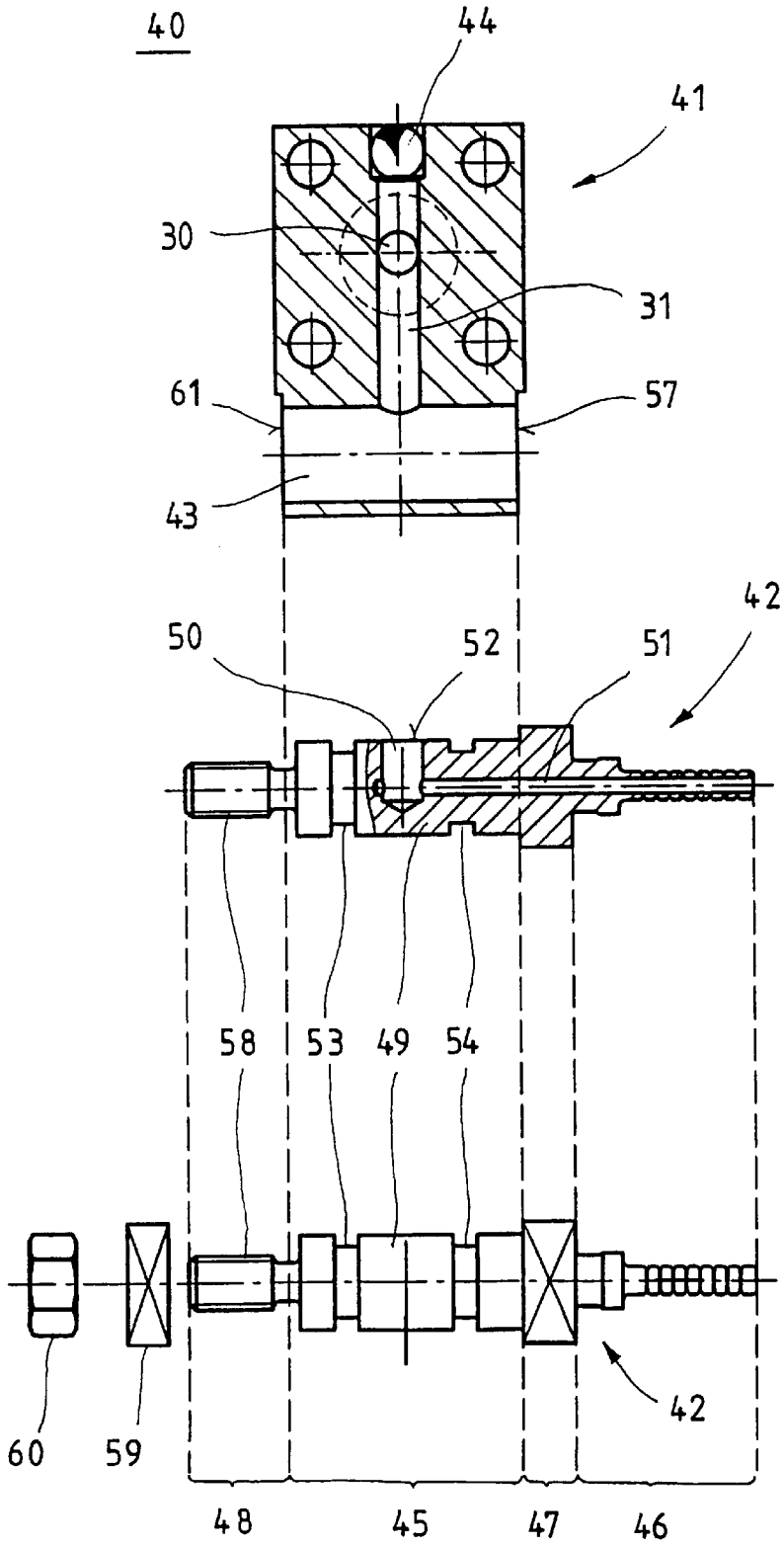
FIG. 5 shows a two-part connection unit in the manner of an exploded view.
Figure 6:
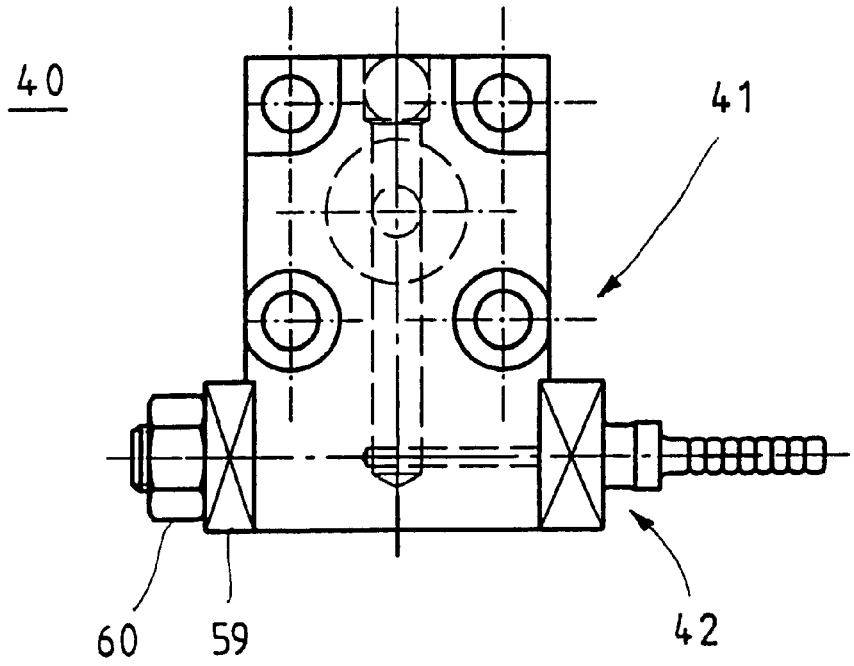
FIG. 6 shows a plan view of the connection unit according to FIG. 5 in the mounted state.
Figure 7:
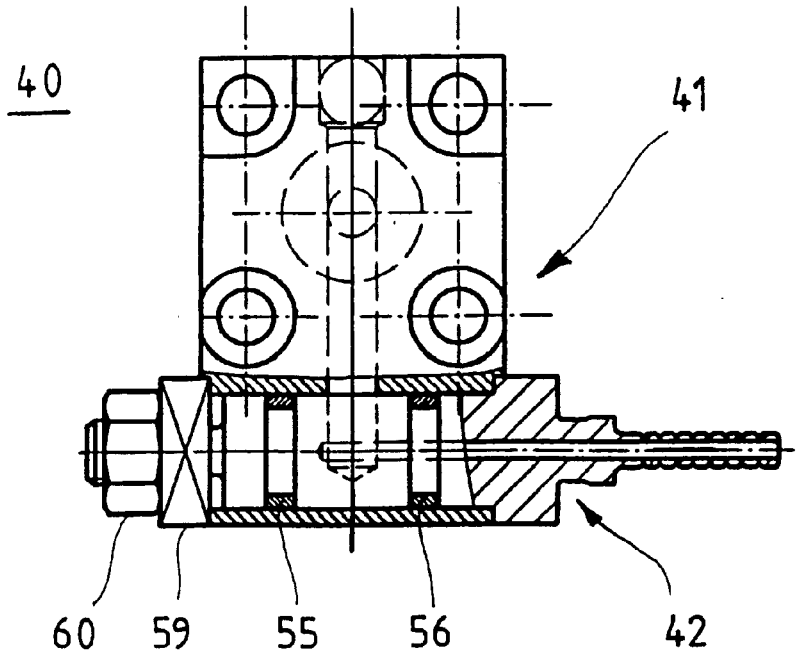
FIG. 7 shows the plan view which is given in FIG. 6, the connection nipple and the surrounding vicinity of the connection plate being represented in partially sectional form.

In the case of the connection plates 12 and 13 which are illustrated in FIGS. 1 to 4, the connection nipple 33 is integrated into the connection plate 12, and the connection nipple 34 is integrated into the connection plate 13. The connection plate and connection nipple are therefore each fabricated from one piece. Such connection plates require a large expenditure in terms of fabrication equipment. FIGS. 5 to 7 show a two-part connection unit 40 which can be fabricated more cost-effectively than a single-part connection plate. The two-part connection unit 40 is composed of a connection plate 41 and a connection nipple 42. As in the case of the connection plate 12, the connection plate 41 projects beyond the square base surface of the bearing region.

FIG. 5 shows, in the manner of an exploded view under the connection plate 41, the connection nipple 42, once in a partially sectional view and once in a plan view. The connection plate 41 is—like the connection plate 12—provided with ducts 30 and 31 for the pressure medium. The duct 31 opens into a hole 43. The other outlet opening of the duct 31 out of the connection plate 41 is closed off by a pressed-in ball 44. The connection nipple 42 is divided into four regions 45 to 48. The region 45 is embodied as a cylindrical bolt 49. The cylindrical bolt 49 is provided with ducts 50 and 51. The duct 50 is aligned with the duct 31 in the connection plate 41. The outlet opening of the duct 50 is provided with the reference numeral 52. The duct 51 extends from the region 46, which serves to receive the hose receptacle, via the region 47 and into the region 45 and opens into the duct 50 there. The cylindrical bolt 49 is provided on both sides of the outlet opening 52 with, in each case, one annular groove 53 and 54. The annular grooves 53 and 54 serve to receive sealing rings 55 and 56, respectively. As illustrated in FIG. 7, the sealing rings 55 and 56 are arranged between the cylindrical bolt 49 and the wall of the hole 43 and prevent pressure medium from emerging from the gap between the cylindrical bolt 49 and the hole 43. The region 47 of the connection nipple 42 is embodied as an abutment for the connection nipple 42 against a side wall of the connection plate 41. It engages in the mounted state in a first chamfer 57 of the connection plate 41 in the vicinity of the one outlet opening of the hole 43. The connection nipple 42 has a square cross section in the region 47. However, it is also possible to use a rectangular cross section instead of the square cross section. Owing to the square cross section, the region 47 acts as an antitwist protection for the connection nipple 42. This measure ensures that the ducts 31 and 50 are connected to one another. The cylindrical bolt 49 is provided with a threaded bolt 58 on the side facing away from the region 47. As illustrated in FIGS. 6 and 7, the threaded bolt 58 is provided in the mounted state with a washer 59 and a nut 60. The washer 59 has the same cross section as the region 47. It engages in a second chamfer 61 of the connection plate 41. Since the chamfers 57 and 61 are of the same size, the connection nipple 42 can be introduced into the hole 43 from both sides. In conjunction with the symmetrical design of the connection plate 42, which ensures that the ducts 31 and 50 are aligned, it is thus possible to realize a hose connection either from one side or from the other side.

FIG. 6 shows a plan view of the assembled connection unit 40, in which the connection nipple 42 is inserted into the hole 43 of the connection plate 41.

FIG. 7 also shows a plan view of the assembled connection unit 40, the connection nipple 42 and the surrounding region of the connection plate 42 being represented in partially sectional form. This figure shows in particular the sealing rings 55 and 56.

In the case of the connection unit 40 illustrated in FIGS. 5 to 7, the hose connection is effected—as in the case of the single-part connection plate—outside the square base surface of the flattened portion of the casing 11. However, it is also possible to embody the connection unit in such a way that the connection nipple is arranged—as in the case of the connection plate 13—within the square base surface (that is between the attachment screws 19 and 20).

What is claimed is:

1. An arrangement for the supply of pressure medium to a hydraulic or pneumatic cylinder, wherein an outside of a casing (11) of the cylinder (10) is flattened in vicinity of an exit point of a duct (26) provided for the supply of pressure medium, a connection plate (13; 41) which is provided with ducts (30, 31, 51) for the pressure medium is secured to a flattened part (27) of the casing (11), and the connection plate (13; 41) is provided with a port (34; 42) for a pressure medium line, wherein the port (34; 42) for the pressure medium line is embodied as a connection nipple, said connection nipple having at least a cylindrical bolt (49) and a hose receptacle (46), and that the cylindrical bolt (49) is provided with ducts (50; 51) for the pressure medium and is secured in a hole (43) which runs through the connection plate (41), wherein the cylindrical bolt (49) is provided with a radial blind hole (50) which opens into a second blind hole (51) which extends from the hose receptacle (46) of the connection nipple (42) in axial direction, and sealing rings (55, 56) are arranged between the cylindrical bolt (49) and the hole (43) in the connection plate (41) on both sides of an outlet opening (52) of the radial blind hole (50).

2. The arrangement as claimed in claim 1, wherein the connection plate (13; 41) is secured to the casing (11) by a screwed connection (14 to 17; 18 to 21).

3. The arrangement as claimed in claim 2, wherein a bearing region (27) of the connection plate (13; 41) has a rectangular base surface, and the connection plate (13; 41) is secured to the casing (11) by four screws (14 to 17; 18 to 21) which are arranged in the corners of the rectangular base surface.

4. The arrangement as claimed in claim 3, wherein the ducts (30, 31, 51) in the connection plate (41) deflect a direction of flow of the pressure medium.

5. The arrangement as claimed in claim 4, wherein the port (34; 42) for the pressure medium line is arranged parallel to the longitudinal axis of the cylinder (10).

6. The arrangement as claimed in claim 4, wherein the connection plate (41) projects beyond the rectangular base surface on one side, and the port (42) for the pressure medium line on the part which projects beyond the rectangular base surface is arranged perpendicularly with respect to a longitudinal direction of the connection plate (41).

7. The arrangement as claimed in claim 2, wherein a bearing region (27) of the connection plate (13; 41) has a square base surface, and the connection plate (13; 41) is secured to the casing (11) by four screws (14 to 17; 18 to 21) which are arranged in the corners of the square base surface.

8. The arrangement as claimed in claim 1, wherein the connection nipple (42) is divided into a plurality of regions (45 to 48), a first region (45) of which is embodied as the cylindrical bolt (49) and a second region (46) of which serves as the hose receptacle.

9. The arrangement as claimed in claim 8, wherein a third region (47) is formed between the first region (45) and the second region (46) of the connection nipple (42), on a side face of the connection plate (41), as an abutment for the connection nipple (42), and by the cylindrical bolt (49) is continuous, on a side facing away from the third region (47), with a fourth region (48) which is provided with a thread (58).

10. The arrangement as claimed in claim 9, wherein the fourth region (48) of the connection nipple (41) is embodied as a threaded bolt (58), and the part of the threaded bolt (58) which projects out of the hole (43) is provided with a nut (60) which is supported on the connection plate (41).

11. The arrangement as claimed in claim 10, wherein the connection plate (41) is provided with a chamfer (57) in a vicinity of the outlet opening of the hole (43).

12. The arrangement as claimed in claim 11, wherein the connection plate (41) is also provided with a chamfer (61) in a vicinity of another outlet opening of the hole (43).

13. The arrangement as claimed in claim 1, wherein the sealing rings (55, 56) are secured in annular grooves (53, 54) of the cylindrical bolt (49).

* * * * *